US010499178B2

(12) United States Patent
Arana

(10) Patent No.: US 10,499,178 B2
(45) Date of Patent: Dec. 3, 2019

(54) SYSTEMS AND METHODS FOR ACHIEVING MULTI-DIMENSIONAL AUDIO FIDELITY

(71) Applicant: Disney Enterprises, Inc., Burbank, CA (US)

(72) Inventor: Mark Arana, West Hills, CA (US)

(73) Assignee: Disney Enterprises, Inc., Burbank, CA (US)

( * ) Notice: Subject to any disclaimer, the term of this patent is extended or adjusted under 35 U.S.C. 154(b) by 11 days.

(21) Appl. No.: 15/293,537

(22) Filed: Oct. 14, 2016

(65) Prior Publication Data

US 2018/0109899 A1 Apr. 19, 2018

(51) Int. Cl.
*H04S 7/00* (2006.01)
*H04R 5/02* (2006.01)

(52) U.S. Cl.
CPC ..... *H04S 7/302* (2013.01); *H04R 5/02* (2013.01); *H04S 2400/11* (2013.01)

(58) Field of Classification Search
CPC combination set(s) only.
See application file for complete search history.

(56) References Cited

U.S. PATENT DOCUMENTS 6,829,018 B2 * 12/2004 Lin ..... H04S 5/005 348/515
8,996,538 B1 * 3/2015 Cremer ..... G06F 16/24578 707/749
2008/0165992 A1 * 7/2008 Kondo ..... H04N 7/0122 381/182
2009/0147961 A1 * 6/2009 Lee ..... H04S 3/008 381/2
2010/0306655 A1 * 12/2010 Mattingly ..... G06Q 10/10 715/720
2010/0309284 A1 * 12/2010 Samadani ..... G06Q 10/10 348/14.08
2012/0320066 A1 * 12/2012 James ..... G06T 13/00 345/473
2013/0169742 A1 * 7/2013 Wu ..... H04N 7/147 348/14.08
2013/0329922 A1 * 12/2013 Lemieux ..... H04S 7/30 381/307
2016/0080866 A1 * 3/2016 Agustin ..... H03G 3/3005 381/77
2016/0269712 A1 * 9/2016 Ostrover ..... H04S 7/302
(Continued)

FOREIGN PATENT DOCUMENTS

WO WO 2015177224 A1 * 11/2015 ..... H04S 7/30

*Primary Examiner* — Duc Nguyen
*Assistant Examiner* — Assad Mohammed
(74) *Attorney, Agent, or Firm* — Farjami & Farjami LLP

(57) ABSTRACT

There is provided a non-transitory memory storing an executable code, a hardware processor executing the executable code to receive a visualization of a three-dimensional (3D) position for each audio object of a plurality of audio objects in a first mix of an object-based audio of a media content, the visualization corresponding to a timeline of the media content, receive a second mix of the object-based audio of the media content, and play the second mix of the object-based audio of the media content using an audio playback system while displaying the visualization of the 3D position for each of the plurality of audio objects of the first mix of the object-based audio on a display.

20 Claims, 4 Drawing Sheets

(56) References Cited

U.S. PATENT DOCUMENTS

| | | | | |
|---|---|---|---|---|
| 2016/0381459 | A1* | 12/2016 | Baca | H04N 13/254<br>386/227 |
| 2017/0132845 | A1* | 5/2017 | Everman, II | G06T 19/006 |
| 2017/0186232 | A1* | 6/2017 | Dange | G06F 3/011 |

* cited by examiner

SYSTEMS AND METHODS FOR ACHIEVING MULTI-DIMENSIONAL AUDIO FIDELITY

BACKGROUND

Advances in audio technology, such as the introduction of audio playback systems including more and more speakers, have significantly improved the listeners' experience in modern theaters and dance clubs. In the past, surround sound offered a significant improvement over stereo sound by introducing audio that played on all sides of the listener in a two-dimensional audio experience. Multi-dimensional audio systems improved surround sound by allowing media producers to add a height component to sounds in media contents. Today, object-based audio is further improving the listeners' experience.

SUMMARY

The present disclosure is directed to systems and methods for achieving multi-dimensional audio fidelity, substantially as shown in and/or described in connection with at least one of the figures, as set forth more completely in the claims.

DETAILED DESCRIPTION

Figure 1:
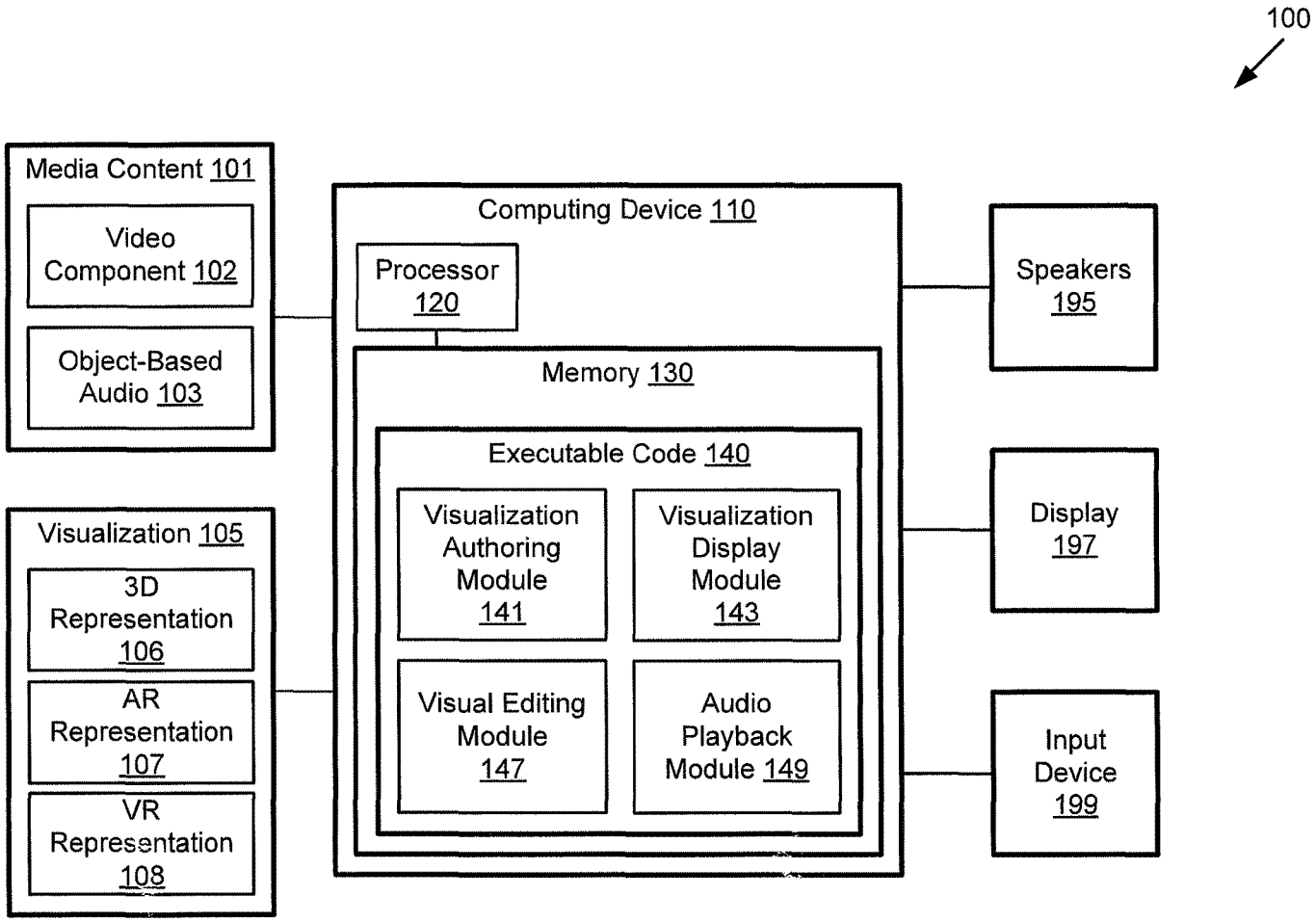
FIG. 1 shows a diagram of an exemplary system for achieving multi-dimensional audio fidelity, according to one implementation of the present disclosure.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1 shows a diagram of an exemplary system for achieving multi-dimensional audio fidelity, according to one implementation of the present disclosure. Diagram 100 shows media content 101, visualization 105, and computing device 110. Media content 101 may be an audio content, such as a song or a music album, a video content, such as a television show or a movie, a game content, such as a computer game, etc. As shown in FIG. 1, media content 101 includes video component 102 and object-based audio component 103. In some implementations, video component 102 may include a plurality of frames of media content 101 such as a plurality of video frames of a movie or television show. In other implementations, video component 102 may include a video content to complement an audio content, such as a video content corresponding to a song.

Object-based audio 103 may be an audio of media content 101, and may include a plurality of audio components, such as a dialog component, a music component, and an effects component. In some implementations, object-based audio 103 may include an audio bed and a plurality of audio objects, where the audio bed may include traditional static audio elements, bass, treble, and other sonic textures that create the bed upon which object-based directional and localized sounds may be built. Audio objects in object-based audio 103 may be localized or panned around and above a listener in a multidimensional sound field, creating an audio experience for the listener in which sounds travel around the listener. In some implementations, an audio object may include audio from one or more audio components.

Visualization 105 may be a visual representation of a listening environment and a plurality of audio objects in object-based audio 103. For example, visualization 105 may be a virtual room representing a movie theater, a home theater, a dance club, or other environment in which object-based audio 103 may be played. In some implementations, a user, such as a music producer, may use visualization 105 to verify that a mix of object-based audio 103 that is intended for an audio playback system sounds substantially similar to a first mix of object-based audio 103 in media content 101 when the mix is played on the intended audio playback system. For example, the user may play media content 101, including object-based audio 103, and the user may see the position of various audio objects included in object-based audio 103 as the audio objects should appear aurally to a listener in a listening environment represented by visualization 105 based on the creative intent behind object-based audio 103. In some implementations, visualization 105 may include one or more visualizations. As shown in FIG. 1, visualization 105 includes three-dimensional (3D) representation 106, augmented reality (AR) representation 107, and virtual reality (VR) representation 108.

Three-dimensional representation 106 may be a 3D representation of a listening environment. In some implementations, 3D representation 106 may include a 3D model for display on display 197, such as a wire frame representation of a listening environment and one or more audio objects of object-based audio 103. Three-dimensional representation 106 may be used to visualize the location of various audio objects of object-based audio 103 when object-based audio 103 is mixed for playback on a playback system. For example, 3D representation 106 may be displayed on display 197, and the position of a plurality of audio objects that are included in object-based audio 103 may be shown as the audio objects would appear aurally to a listener in the listening environment represented by 3D representation 106. The audio objects may be shown visually in 3D representation 106 as they would appear aurally to a listener in the listening environment when object-based audio 103 is played using a stereo playback system, a surround-sound playback system, such as a 5.1 surround-sound playback system, a 7.1 surround-sound playback system, an 11.1 surround-sound playback system, etc.

Augmented reality representation 107 may be an augmented reality representation of a listening environment. In some implementations, AR representation 107 may include an augmented reality model for display using an augmented reality device (not shown), such as an augmented reality headset. Augmented reality representation 107 may be used to visualize the location of various audio objects of object-based audio 103 when object-based audio 103 is mixed for playback on a playback system. For example, AR representation 107 may be viewed using an augmented reality headset, and the position of each of a plurality of audio objects that are included in object-based audio 103 may be shown as the audio objects would appear aurally to a listener in the listening environment represented by AR representation 107. The audio objects may be shown visually in AR representation 107 as they would appear aurally to a listener in the listening environment when object-based audio 103 is played using a stereo playback system, a surround-sound playback system, such as a 5.1 surround-sound playback system, a 7.1 surround-sound playback system, an 11.1 surround-sound playback system, etc.

Virtual-reality representation 108 may be a virtual reality representation of a listening environment. In some implementations, VR representation 108 may include a virtual reality model for display using a virtual-reality device (not shown), such as a virtual-reality headset. Virtual reality representation 108 may be used to visualize the location of various audio objects of object-based audio 103 when object-based audio 103 is mixed for playback on a playback system. For example, VR representation 108 may be viewed using a virtual reality headset, and the position of a each of a plurality of audio objects that are included in object-based audio 103 may be shown as the audio objects would appear aurally to a listener in the listening environment represented by VR representation 108. The audio objects may be shown visually in VR representation 108 as they would appear aurally to a listener in the listening environment when object-based audio 103 is played using a stereo playback system, a surround-sound playback system, such as a 5.1 surround-sound playback system, a 7.1 surround-sound playback system, an 11.1 surround-sound playback system, etc.

Computing device 110 is a computing system for use in achieving multi-dimensional audio fidelity. As shown in FIG. 1, computing device 110 includes processor 120, and memory 130. Processor 120 is a hardware processor, such as a central processing unit (CPU) found in computing devices. Memory 130 is a non-transitory storage device for storing computer code for execution by processor 120, and also for storing various data and parameters. As shown in FIG. 1, memory 130 includes executable code 140. Executable code 140 may include one or more software modules for execution by processor 120. As shown in FIG. 1, executable code 140 includes visualization authoring module 141, visualization display module 143, visual editing module 147, and audio playback module 149.

Visualization authoring module 141 is a software module stored in memory 130 for execution by processor 120 to author a visualization of audio objects in object-based audio 103. In some implementations, visualization authoring module 141 may author a visualization of an exemplary listening environment and a position of a plurality of audio objects in the exemplary listening environment. For example, the visualization authoring module 141 may record the creative intent of object-based audio 103, or may author or add a music track that can be moved across a room. In one implementation, the visualization of object-based audio 103 may correspond to the time line or time code of media content 101. In some implementations, visualization authoring module 141 may author a position of each audio object of object-based audio 103, a size of each audio object of object-based audio 103, etc., so as to create an aural representation which includes the perception of desired size and location. The visualization authored by visualization authoring module 141 may be played with video component 102 to allow a producer, quality control person, or other listener to verify that a mix of object-based audio 103 played back over a playback system matches the creative intent of object-based audio 103.

Visualization display module 143 is a software module stored in memory 130 for execution by processor 120 to display a visualization of object-based audio 103. In some implementations, visualization display module 143 may display a visualization of a listening environment in which object-based audio 103 may be heard, such as 3D representation 106, AR representation 107, VR representation 108, etc. Visualization display module 143 may display a visualization of each audio object of the plurality of audio objects in object-based audio 103 and the position of each audio object in the listening environment according to the creative intent behind object-based audio 103. In one implementation, visualization display module 143 may show a visualization of a movie theater including a virtual screen showing video component 102 and a visualization of the movie theater including visualizations of each audio object in object-based audio 103. Visualization display module 143 may show the original creative intent of object-based audio 103 while a user, such as a producer or sound engineer, listens to a mix of object-based audio 103 played using a playback system.

Visualization display module 143 may show the movement of audio objects in the listening environment while the user listens to the playback over the playback system.

Visual editing module 147 is a software module stored in memory 130 for execution by processor 120 to receive user inputs editing a mix of object-based audio 103 based on a visualization of the mix of object-based audio 103. In one implementation, visual editing module 147 may allow a user to interact with the audio objects in visualization 105 during a playback or in real-time, such as live mixing.

Visual editing module 147 may receive input from input device 199, such as a user input selecting an audio object in visualization 105. Visual editing module 147 may allow a user to create a mix of object-based audio 103 or alter a mix of object-based audio 103 based on visualizations of audio objects in visualization 105. In some implementations, the user may select an audio object and reposition the audio object in visualization 105. In some implementations, the user may select and reposition audio objects during playback or live mixing of media content 101, and playing object-based audio 103 over speakers 195 may reflect the change in position of the audio object in real time. For example, object-based audio 103 may be played in a dance club, and the DJ may select an audio object representing the sound of a high-hat cymbal in object-based audio 103 using input device 199. The DJ may move the high-hat cymbal audio object around visualization 105, and visual editing module 147 may cause the high-hat cymbal sound to move around the dance club, for example, by causing different speakers of speakers 195 to play the high-hat cymbal sound.

Audio playback module 149 is a software module stored in memory 130 for execution by processor 120 to play object-based audio 103 and/or a mix of object-based audio 103 over speakers 195. In some implementations, audio playback module 149 may play a mix of object-based audio 103 using one or more speakers of speakers 195. Speakers 195 may include a plurality of speakers for playing object-based audio 103 and/or various mixes of object-based audio 103. For example, speakers 195 may include a subwoofer and center, front, and rear speakers for playing a surround-sound 5.1 mix of object-based audio 103; a subwoofer and center, front, side, and rear speakers for playing a surround-sound 7.1 mix of object-based audio 103; a subwoofer and center, front, side, and rear speakers for playing a surround-sound 11.1 mix of object-based audio 103; a subwoofer and a plurality of speakers for playing a multi-dimensional mix of object-based audio 103, such as a mix of object-based audio 103 for playback over a Dolby Atmos® playback system, a DTS:X™ playback system, or other multi-dimensional audio playback system. Display 197 may be a display for showing video component 102 of media content 101 and/or integrated in computing device 110, or may be a separate display device that is electronically connected to computing device 110, such as a headset for viewing AR content, e.g., AR representation 107, and/or VR content, e.g., VR representation 108. In some implementations, audio playback module 149 may connect with a user device, such as a tablet computer, a personal audio player, a mobile phone, etc., to deliver object-based audio 103 to the user. Audio playback module 149 may playback object-based audio 103 using the user device.

Input device 199 may be an input device for selecting and/or repositioning audio objects in visualization 105. In some implementations, input device 199 may include a computer keyboard, a computer mouse, a touch-screen interface, etc. In other implementations, input device 199 may be an input device allowing the user to interact with an AR representation or VR representation of object-based audio 103, such as a glove or paddle for interacting with virtual objects, such as audio objects, in an AR or VR environment.

Figure 2A:
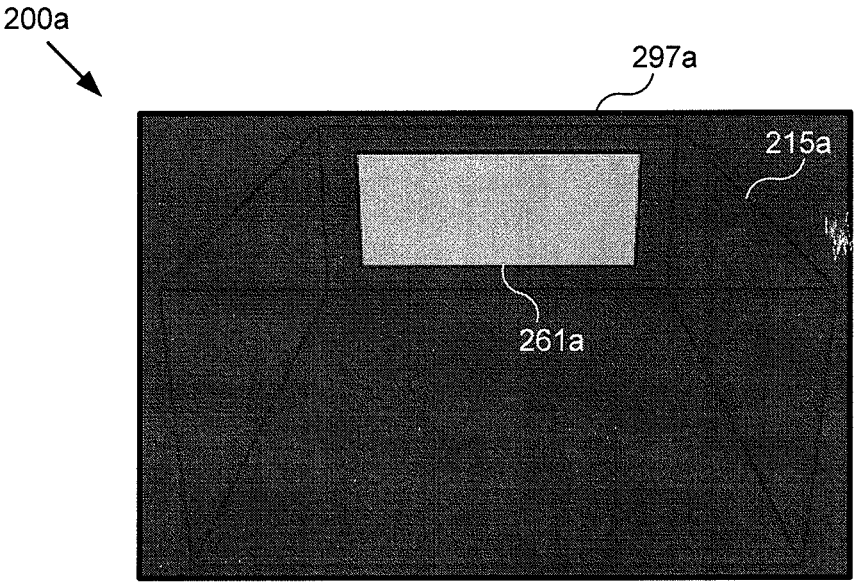
FIG. 2*a* shows a diagram of an exemplary visualization of a listening environment, according to one implementation of the present disclosure.
Figure 2B:
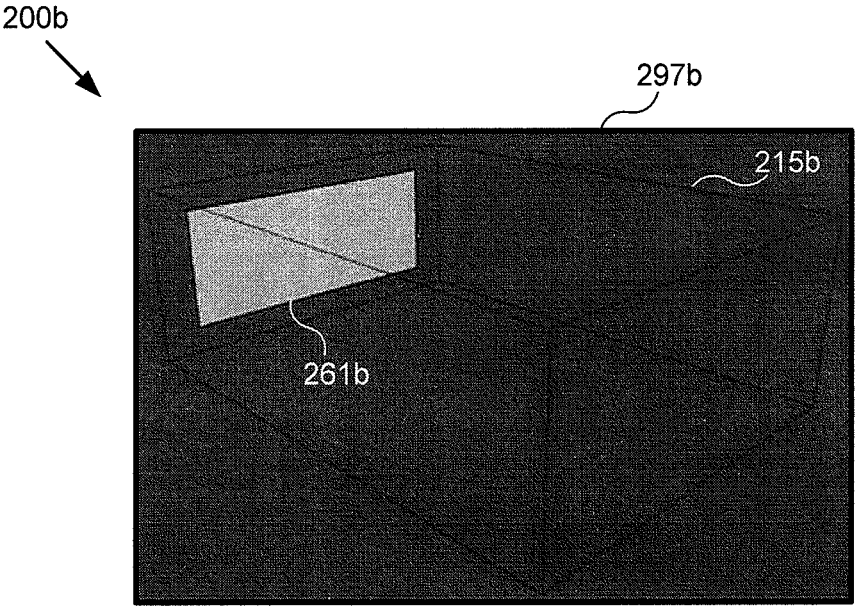
FIG. 2*b* shows another diagram of the exemplary visualization of the listening environment, according to one implementation of the present disclosure.

FIG. 2*a* shows a diagram of an exemplary visualization of listening environment 215*a*, according to one implementation of the present disclosure. Diagram 200*a* shows a visualization of listening environment 215*a* shown on display 297*a*. In some implementations, listening environment 215*a* may represent a movie theater, a home theater, a dance club, or other environment where a listener may listen to object-based audio 103. Listening environment 215*a* includes screen 261*a*, which may be a screen in a movie theater, a television or other display in a home theater, a screen for displaying video content in a dance club, etc. FIG. 2*b* shows another diagram of the exemplary visualization of the listening environment, according to one implementation of the present disclosure. FIG. 2*b* shows a rotated view of listening environment 215. In some implementations, during creation of an audio mix, such as a mix of an object-based audio for a movie or an object-based song for playing in a dance club, a producer, sound engineer, or other user, may place various audio objects in listening environment 215.

Figure 3:
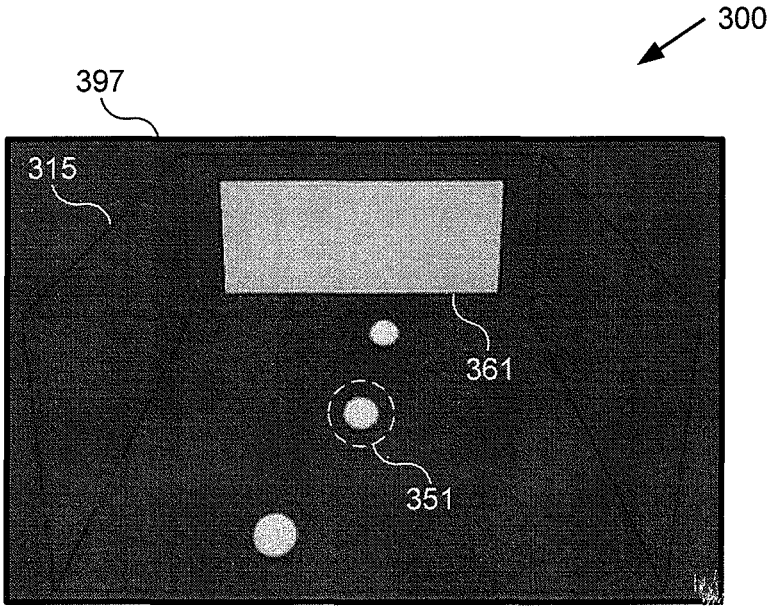
FIG. 3 shows a diagram of an exemplary listening environment including a plurality of audio objects, according to one implementation of the present disclosure.

FIG. 3 shows a diagram of an exemplary listening environment including a plurality of audio objects, according to one implementation of the present disclosure. Display 397 shows listening environment 315 including a plurality of audio objects, such as audio object 351, and virtual screen 361. Each audio object has a position in listening environment 315, and each audio object has a size. In some implementations, the size of an audio object may affect a number of speakers used in creating the audio object during playback. For example, a small audio object may be played back using sound emitted from a single speaker, whereas a larger audio object may be played back using sound emitted from a plurality of speakers in the listening environment.

Figure 4:
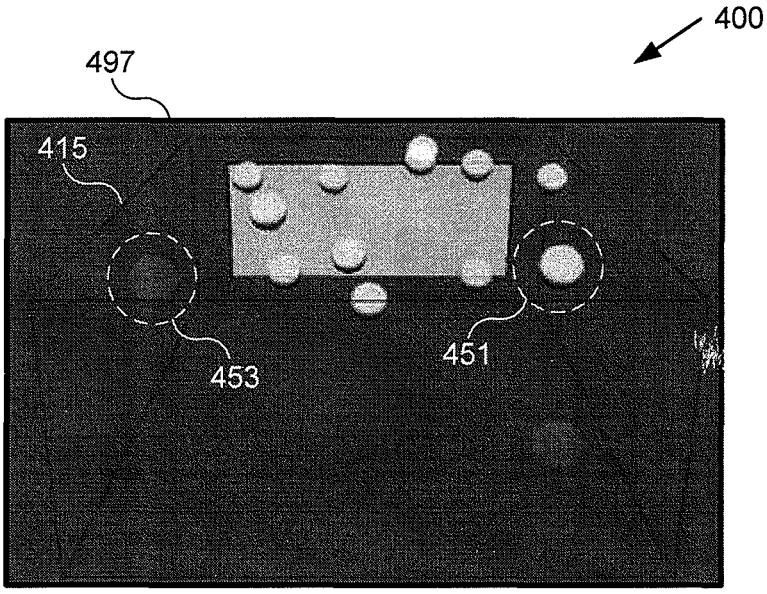
FIG. 4 shows another diagram of the exemplary listening environment including a plurality of audio objects, according to one implementation of the present disclosure.

FIG. 4 shows another diagram of the exemplary listening environment including a plurality of audio objects, according to one implementation of the present disclosure. Diagram 400 shows listening environment 415 displayed on display 497. Listening environment 415 includes active sounds, indicated by highlighted audio objects such as audio object 451, and inactive audio objects, indicated by audio objects that are not highlighted, such as audio object 453. Inactive audio objects may be audio objects that are not presently played over any of speakers 195, but that are still part of object-based audio 103. In some implementations, sound-objects that are not highlighted may represent audio objects that are not currently audible in media content 101, but that visual editing module 147 and audio playback module 149 are tracking in visualization display module 143. In other implementations, active audio object 451 may represent an audio object that has been selected by a user for visual editing of object-based audio 103, and inactive audio object 451 may represent an audio object of object-based audio 103 that has not been selected for visual editing.

Figure 5:
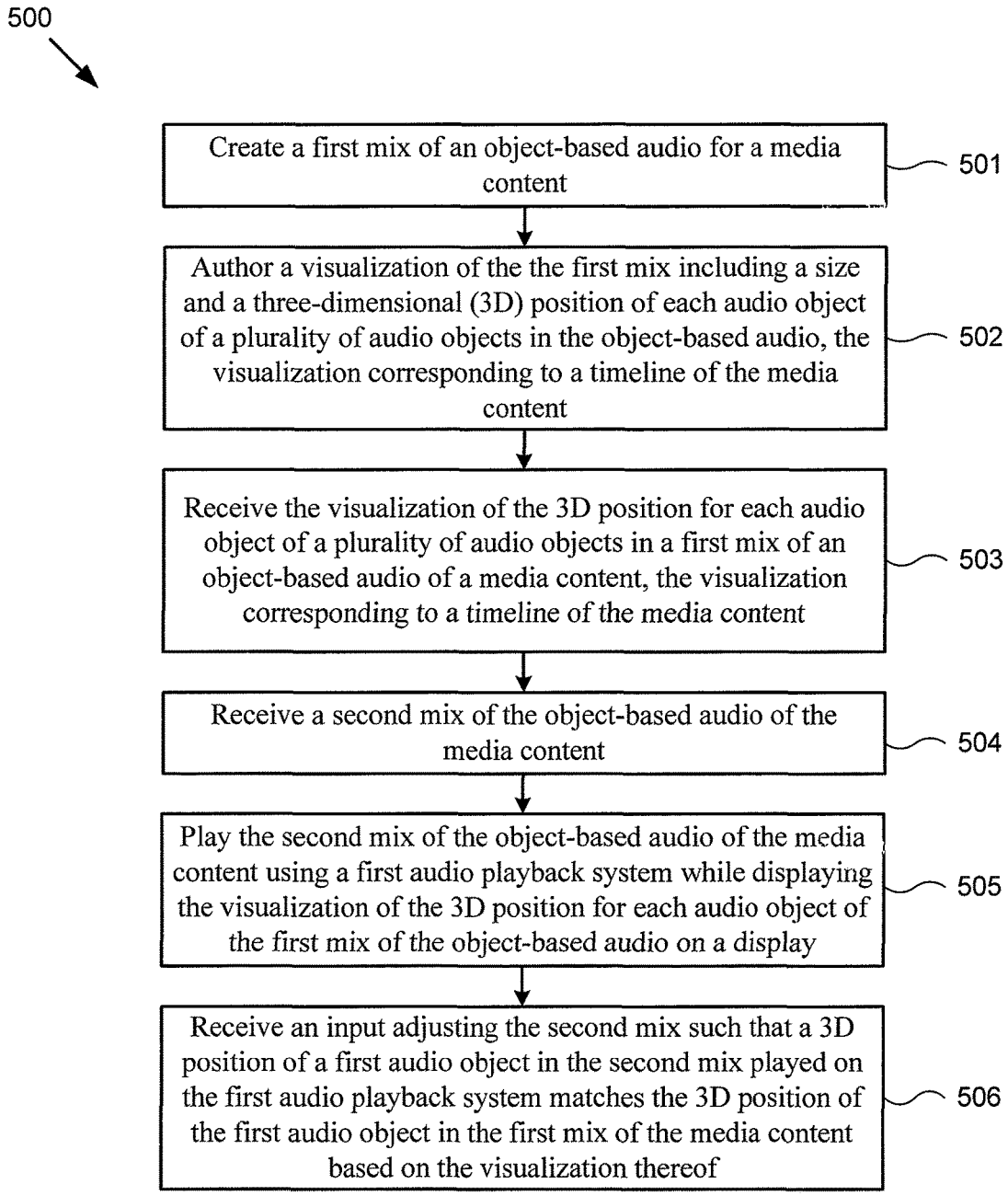
FIG. 5 shows a flowchart illustrating an exemplary method of achieving multi-dimensional audio fidelity, according to one implementation of the present disclosure.

FIG. 5 shows a flowchart illustrating an exemplary method of achieving multi-dimensional audio fidelity, according to one implementation of the present disclosure. Method 500 begins at 501, where a user creates a first mix of object-based audio 103 for media content 101. In some implementations, the first mix may be a multi-dimensional mix for playback over a multi-dimensional playback system. In some implementations, a multi-dimensional playback system may include a plurality of speakers, including speakers in front of a listener in the listening environment, to the sides, behind, above, and/or below a listener in the listening environment, such as a Dolby Atmos® playback system, a DTS:X™ playback system, etc. The first mix of object-based audio 103 may include a plurality of audio objects. Each audio object of the plurality of audio objects may have a position and a size. The first mix of object-based audio 103 may create an immersive audio experience in which a listener may hear each audio object of the plurality of audio objects move around and/or through the listening environment. In some implementations, the movement of the audio objects may correspond to events in visual component 102.

At 502, executable code 140 authors visualization 105 of the first mix, including a size and a 3D position of each audio object of a plurality of audio objects in object-based audio 103, visualization 105 corresponding to a timeline of media content 101. Visualization 105 of the first mix of object-based audio 103 may include a visualization of each audio object in object-based audio 103, including a 3D position in the listening environment and a size of each audio object. Visualization 105 of the first mix of object-based audio 103 may include the movement of each audio object of the plurality of audio objects in object-based audio 103 as the audio objects move around and/or through the listening environment. Visualization 105 may represent the creative intent behind object-based audio 103. In some implementations, the visualization may correspond to a timeline of visual component 102. Visualization 105 may be authored during the creation of the first mix.

At 503, executable code 140 receives visualization 105 including the 3D position for each audio object in a first mix of object-based audio 103 of media content 101. In some implementations, visualization 105 may include 3D representation 106, AR representation 107, and/or VR representation 108. Visualization 105 may include a model of a listening environment where media content 101 may be played, such as a movie theater, a home theater, a dance club, etc. Visualization 105 may include a visualization of each of a plurality of audio objects in object-based audio 103. Each audio object included in visualization 105 may move through and/or around the listening environment. In some implementations, the visualization may be matched to a timeline of media content 101 such that the position of each audio object, and the movement of each audio object, may correspond to visual component 102.

At 504, executable code 140 receives a second mix of object-based audio 103 of media content 101. The second mix may be a mix of object-based audio 103 for playback on an in-home playback system, such as a surround-sound 5.1 playback system, a surround-sound 7.1 playback system, a surround-sound 11.1 playback system, etc., where the playback system corresponds to the audio configuration of the second mix. In some implementations, the audio playback system may be a commercially available audio system, such as an in-home audio system.

At 505, executable code 140 plays the second mix of object-based audio 103 of media content 101 using a first audio playback system while displaying visualization 105 of the 3D position for each audio object of the first mix of object-based audio 103 on display 197. In some implementations, display 197 may be a computer monitor showing 3D representation 106 of the listening environment and showing each audio object of object-based audio 103 moving through and/or around 3D representation 106. In other implementations, display 197 may be an augmented reality display, such as an augmented reality headset, such that a listener may look around and see the position of each audio object of object-based audio 103 as it moves through the listening environment. In still other implementations, display 197 may be a virtual reality display, such as a virtual reality headset, showing the positions of each audio object of object-based audio 103 as the audio objects move through and/or around visualization 105.

At 506, executable code 140 receives an input adjusting the second mix such that a 3D position of a first audio object in the second mix played on the first audio playback system matches the 3D position of the first audio object in object-based audio 103 based on visualization 105. In some implementations, a user may use input device 199 to adjust the second mix of object-based audio 103. For example, changing the position of an audio object in visualization 105 may change the second mix of object-based audio 103. When the user determines that a sound in the second mix does not aurally correspond to the audio object in visualization 105, the user may select and reposition the audio object in visualization 105. In some implementations, the user may select and reposition the audio object using a computer mouse. In other implementations, the user may select and reposition the audio object in virtual space, such as using gloves or paddles in conjunction with an AR headset or a VR headset to select and reposition the audio objects in AR or VR.

From the above description, it is manifest that various techniques can be used for implementing the concepts described in the present application without departing from the scope of those concepts. Moreover, while the concepts have been described with specific reference to certain implementations, a person having ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A system comprising:

a non-transitory memory storing an executable code;

a hardware processor executing the executable code to:

receive a visualization of a three-dimensional (3D) position for each audio object of a plurality of audio objects created according to a first mix of an object-based audio of a media content having a video component complementing the object-based audio, the visualization corresponding to a timeline of the media content;

receive a second mix of the object-based audio of the media content; and play, on an audio playback system, the second mix of the object-based audio of the media content only, and not the first mix of the object-based audio, while displaying the visualization of the 3D position for each of the plurality of audio objects created according to the first mix of the object-based audio on a display in accordance with the timeline of the media content;

wherein the visualization shows, on the display, a 3D virtual room and the plurality of audio objects spread throughout the 3D virtual room, according to the 3D position of each of the plurality of audio objects, and wherein the visualization further shows that the 3D virtual room includes a virtual screen playing the video component in accordance with the timeline of the media content and the visualization also shows at least one or more of the plurality of audio objects are positioned away from the virtual screen in the 3D virtual room and move around the 3D virtual room according to the first mix of the object-based audio in accordance with the timeline of the media content.

2. The system of claim 1, wherein the hardware processor further executes the executable code to:

receive an input adjusting the second mix such that a 3D position of a first audio object in the second mix played on the audio playback system matches the 3D position of the first audio object in the first mix of the object-based audio of the media content based on the visualization thereof.

3. The system of claim 1, wherein the first mix of the object-based audio of the media content is a multi-dimensional audio.

4. The system of claim 1, wherein the second mix of the object-based audio is one of a 5.1 surround-sound mix, a 7.1 surround-sound mix, and an 11.1 surround-sound mix.

5. The system of 4, wherein the audio playback system corresponds to an audio configuration of the second mix.

6. The system of claim 1, wherein the visualization of the 3D position of each audio object of the plurality of audio objects in the first mix is one of a virtual reality visual representation and an augmented reality visual representation.

7. The system of claim 1, wherein the visualization of the first mix represents a creative intent of the object-oriented audio of the media content.

8. The system of claim 1, wherein an active audio object of the plurality of audio objects is highlighted on the display, and wherein an inactive audio object of the plurality of audio objects is not highlighted on the display.

9. The system of claim 1, wherein the visualization of the 3D position for each audio object of the plurality of audio objects in the first mix is authored during a creation of the first mix.

10. The system of claim 1, wherein each of the plurality of audio objects in the first mix of the object-based audio of the media content has a size indicative of a number of speakers to be used for creating each of the plurality of audio objects during playback, wherein the displaying of the visualization displays the size of each of the plurality of audio objects, and wherein at least one of the plurality of audio objects has a larger size than another one of the plurality of audio objects, the larger size being indicative of using more speakers for playing the at least one of the plurality of audio objects than for playing the another one of the plurality of audio objects.

11. A method for use with a system including a non-transitory memory and a hardware processor, the method comprising:

receiving, using the hardware processor, a visualization of a three-dimensional (3D) position for each audio object of a plurality of audio objects created according to a first mix of an object-based audio of a media content having a video component complementing the object-based audio, the visualization corresponding to a timeline of the media content;

receiving, using the hardware processor, a second mix of the object-based audio of the media content; and playing, using the hardware processor, on an audio playback system, the second mix of the object-based audio of the media content only, and not the first mix of the object-based audio, while displaying the visualization of the 3D position for each of the plurality of audio objects created according to the first mix of the object-based audio on a display in accordance with the timeline of the media content;

wherein the visualization shows, on the display, a 3D virtual room and the plurality of audio objects spread throughout the 3D virtual room, according to the 3D position of each of the plurality of audio objects, and wherein the visualization further shows that the 3D virtual room includes a virtual screen playing the video component in accordance with the timeline of the media content and the visualization also shows at least one or more of the plurality of audio objects are positioned away from the virtual screen in the 3D virtual room and move around the 3D virtual room according to the first mix of the object-based audio in accordance with the timeline of the media content.

12. The method of claim 11, further comprising:

receiving, using the hardware processor, an input adjusting the second mix such that a 3D position of a first audio object in the second mix played on the audio playback system matches the 3D position of the first audio object in the first mix of the object-based audio of the media content based on the visualization thereof.

13. The method of claim 11, wherein the first mix of the object-based audio of the media content is a multi-dimensional audio.

14. The method of claim 11, wherein the second mix of the object-based audio is one of a 5.1 surround-sound mix, a 7.1 surround-sound mix, and an 11.1 surround-sound mix.

15. The method of claim 11, wherein the visualization of the 3D position of each audio object of the plurality of audio objects in the first mix is one of a virtual reality visual representation and an augmented reality visual representation.

16. The method of claim 11, wherein the visualization of the first mix represents a creative intent of the object-oriented audio of the media content.

17. The method of claim 11, wherein an active audio object of the plurality of audio objects is highlighted on the display, and wherein an inactive audio object of the plurality of audio objects is not highlighted on the display.

18. The method of claim 11, wherein the visualization of the 3D position for each audio object of the plurality of audio objects in the first mix is authored during a creation of the first mix.

19. The method of claim 11, wherein each of the plurality of audio objects in the first mix of the object-based audio of the media content has a size indicative of a number of speakers to be used for creating each of the plurality of audio objects during playback, wherein the displaying of the visualization displays the size of each of the plurality of audio objects, and wherein at least one of the plurality of audio objects has a larger size than another one of the plurality of audio objects, the larger size being indicative of using more speakers for playing the at least one of the plurality of audio objects than for playing the another one of the plurality of audio objects.

20. A method for use with a system including a non-transitory memory and a hardware processor, the method comprising:

receiving, using the hardware processor, a visualization of a three-dimensional (3D) position for each audio object of a plurality of audio objects in a first mix of an object-based audio of a media content having a video component complementing the object-based audio, the visualization corresponding to a timeline of the media content;

receiving, using the hardware processor, a second mix of the object-based audio of the media content; and playing, using the hardware processor, on an audio playback system, the second mix of the object-based audio of the media content while displaying the visualization of the 3D position for each of the plurality of audio objects of the first mix of the object-based audio on a display in accordance with the timeline of the media content;

wherein the visualization shows, on the display, a 3D virtual room and the plurality of audio objects spread throughout the 3D virtual room, according to the 3D position of each of the plurality of audio objects, and wherein the visualization further shows that the 3D virtual room includes a virtual screen playing the vides component in accordance with the timeline of the media content and the visualization also shows at least one or more of the plurality of audio objects are positioned away from the virtual screen in the 3D virtual room and move around the 3D virtual room according to the first mix of the object-based audio in accordance with the timeline of the media content;

wherein each of the plurality of audio objects in the first mix of the object-based audio of the media content is shown in the 3D virtual room with a size indicative of a number of speakers to be used for creating each of the plurality of audio objects during playback, wherein the displaying of the visualization displays the size of each of the plurality of audio objects, and wherein at least one of the plurality of audio objects has a larger size than another one of the plurality of audio objects, the larger size being indicative of using more speakers for playing the at least one of the plurality of audio objects than for playing the another one of the plurality of audio objects.

* * * * *